United States Patent [19]

Stäheli et al.

[11] Patent Number: 4,797,979

[45] Date of Patent: Jan. 17, 1989

[54] ARRANGEMENT FOR SUPPLYING A FIBER PROCESSING MACHINE

[75] Inventors: Paul Stäheli, Wilen b/Wil; Fritz Knabenhans, Winterthur, both of Switzerland

[73] Assignee: Maschinenfabrik Rieter AG, Winterthur, Switzerland

[21] Appl. No.: 70,028

[22] Filed: Jul. 6, 1987

[30] Foreign Application Priority Data

Jul. 8, 1986 [CH] Switzerland ..... 02751/86

[51] Int. Cl.[4] ..... D01G 15/40

[52] U.S. Cl. ..... 19/105; 19/112

[58] Field of Search ..... 19/105, 112

[56] References Cited

U.S. PATENT DOCUMENTS

| | | | |
|---|---|---|---|
| 2,068,587 | 1/1937 | Aldrich | 19/105 |
| 3,730,802 | 5/1973 | Stewart et al. | 19/112 X |
| 4,510,949 | 4/1985 | Preston et al. | 19/112 X |
| 4,709,451 | 12/1987 | Leifeld | 19/105 |

FOREIGN PATENT DOCUMENTS

| | | | |
|---|---|---|---|
| 2603825 | 8/1976 | Fed. Rep. of Germany . | |
| 0682071 | 5/1930 | France | 19/112 |
| 0620949 | 12/1980 | Switzerland . | |
| 1284214 | 8/1972 | United Kingdom . | |
| 2073267 | 10/1981 | United Kingdom . | |

*Primary Examiner*—Louis K. Rimrodt

*Attorney, Agent, or Firm*—Werner W. Kleeman

[57] ABSTRACT

The arrangement for supplying a fiber processing machine, such as a card or the like, with fiber flock material comprises a feed device for feeding the fiber flock material to an opening roller having needles distributed over its cylindrical outer or jacket surface. In accordance with the invention, strip-shaped vanes or blades are provided on the outer or jacket surface of the opening roller. These strip-shaped vanes or blades extend substantially parallel to the surface generator lines or generatrices of the cylindrical outer or jacket surface of the opening roller and between the needles thereof. As a result of these measures there is obtained an essentially even or uniform, heavy batt with an appreciably higher batt weight in the feed chute.

11 Claims, 1 Drawing Sheet

ARRANGEMENT FOR SUPPLYING A FIBER PROCESSING MACHINE

BACKGROUND OF THE INVENTION

The present invention relates to a new and improved arrangement for supplying a fiber processing machine, such as a card or the like, with fiber flock material.

Generally speaking, the arrangement or apparatus of the invention for supplying a fiber processing machine, such as by way of example but not limitation, a card or the like, with fiber material or fiber flock material, is of the type comprising a feed device provided with two feed or nipping rollers which conjointly form therebetween a nip line or nip. These two feed or nipping rollers serve to feed fiber flock material to a rotatable substantially cylindrical opening or opener roller. This substantially cylindrical opening or opener roller has needles distributed over its substantially cylindrical outer or jacket surface and which needles extend outwardly therefrom. Furthermore, such substantially cylindrical opening or opener roller is located at the entrance or entrance location of a feed chute leading to or operatively associated with the fiber processing machine.

Such an arrangement is already known from European Published patent application No. 0,175,851. In accordance with the teachings thereof, the provision of a deflecting element or an impact element leads to improved homogeneity of the fiber material collected in the feed chute.

SUMMARY OF THE INVENTION

It is an important object of the present invention to provide an improved construction of an arrangement or apparatus of the aforementioned type for reliably and consistently supplying a fiber processing machine, such as a card or the like, with fibrous material, for instance in the form of a batt, possessing a substantially uniform configuration or evenness and relatively high weight.

Another important object of the present invention is to further considerably improve upon the operation of an arrangement or apparatus of the aforementioned general type for supplying a fiber processing machine, through the provision of quite simple means or structure which results in better homogeneity and greater compactness of the fiber material or feed stock located in the feed chute.

Yet a further notable object of the present invention is directed to the provision of a new and improved construction of an arrangement or apparatus for the infeed or supply of fibrous material to an associated fiber processing machine, wherein such infeed or supply arrangement or apparatus is not only of relatively simple construction and design, and thus quite economical to manufacture and service, but affords the production of a quite uniform and compact fiber structure, such as for instance a batt intended to be delivered to a card or carding machine.

A further significant object of the present invention aims at the provision of an improved construction of an arrangement for the infeed of fibrous material to a fiber processing machine, wherein such infeed arrangement is designed such that there can be reliably realized the production of a desirably processed fibrous material of essentially uniform and compact structure and which infeed arrangement is advantageously constructed such that it can be readily and quite inexpensively retrofitted at desired types of fiber material supply arrangements.

Now in order to implement these and still further objects of the present invention, which will become more readily apparent as the description proceeds, the arrangement of the present development for supplying fiber or fibrous material to a fiber processing machine, is manifested by the features that substantially strip-shaped or strip-like vanes or blades are provided between the needles on the substantially cylindrical outer or jacket surface of the opening roller. These substantially strip-shaped vanes or blades or equivalent structure are arranged substantially parallel to the surface generator lines or generatrices of the substantially cylindrical outer or jacket surface of the opening roller. These substantially strip-shaped vanes or blades are each fixedly secured to the cylindrical outer or jacket surface of the opening roller along one of their long or lengthwise extending sides thereof and each such substantially strip-shaped vane or blade extends outwardly from the substantially cylindrical outer surface of the opening roller. Moreover, the height of the vanes or blades from the substantially cylindrical outer surface of the opening roller is less than the height of the needles from such substantially cylindrical outer surface.

As already indicated previously, the invention thus affords the additional advantage that it is not necessary to change or materially change the form or construction of already existing fiber supply arrangements or installations, in particular there is no requirement for the retrofitting work that additional space be made available, nor is it necessary to provide additional assemblies, in particular bulky assemblies, particularly since it suffices to provide the feed roller having the needles with the additional vane or blade structure.

It is to be noted that, in the previously mentioned European Published patent application No. 0,175,851, the increased homogeneity of the feed stock is obtained by means of a reduction of the kinetic energy of the incoming fiber flocks and by deflection of such fiber flocks. The question can therefore legitimately arise as to whether, due to the provision of the vanes or blades which are additionally contemplated in accordance with the present invention, the fiber flock speed will be again increased so as to cause a degeneration or degradation in the homogeneity of the feed stock. In this connection, it is to be noted that at the location of the opening roller and the two feed or nipping rollers, the feed chute is sealed relatively well with respect to the ambient atmosphere, so that the vanes or blades cause only a small increase in the leakage air passing into the feed chute from the exterior thereof. Thus, assuming constant speed of rotation of the opening roller, there is no reason for a substantially higher speed of the leakage air.

On the other hand, there is a notable increase in the air pressure at the inlet to or entrance location of the feed chute and thus an increase in the pressure exerted upon the fiber material or feed stock, such as the batt, located in the feed chute. The increased air pressure, or the increased air throughflow, produces a pronounced or strong compression of the fiber material or fiber flocks or feed stock located in the feed chute. This compression of the feed stock is generated by the pressure acting thereon and by the quantity of air passing therethrough. A greater degree of compaction of the fiber material or feed stock is obtained since, as practice has shown, there surprisingly occurs an additional homogeneity of the fiber material or feed stock due to the fiber flocks being mutually pressed closer together in such a manner that fiber material is pushed into follow spaces or interstices originally present between the fiber flocks. Therefore, such hollow spaces or interstices are filled with fibers or fiber material and are thus eliminated or appreciably eliminated in this way in addition to being eliminated or appreciably eliminated by the prevailing compression or squeezing action.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 2:
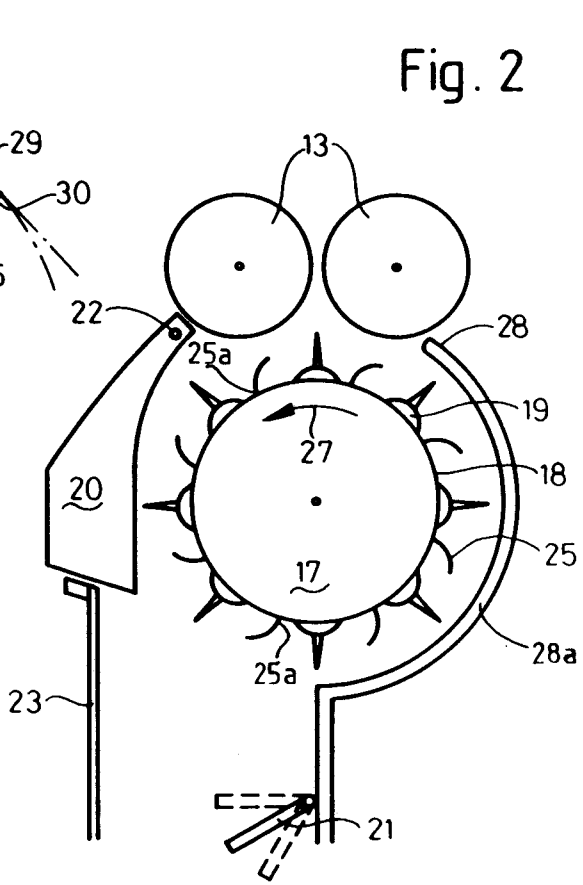
FIG. 2 shows an enlarged view of the region containing the opening roller and the feed or nipping rollers.

Describing now the drawings, it is to be understood that for the purpose of simplifying the illustration thereof only enough of the construction of the arrangement or apparatus for supplying fiber or fibrous material to an associated fiber processing machine, such as for instance to a card or carding machine, has been depicted as will be needed by those skilled in the art to readily understand and appreciate the underlying teachings and concepts of the present invention. Turning therefore now to the showing of FIGS. 1 and 2, it will be understood that fiber or fibrous material appropriately transported or delivered by a suitable and therefore non-illustrated transport duct or the like, is captured or entrained by a fiber material extraction or separation head 11. The fiber material passes from the extraction or separation head 11 into a feed chute 12, at the lower end of which there are arranged two feed or nipping rollers 13 which conjointly form therebetween a nip line or nip 13*a*, as is well known in this particular technology. A perforated wall or wall member 50 or equivalent divider structure separates the feed chute 12 from a plenum chamber 14 or the like which leads to an exhaust housing 15 having an air exit or discharge opening or port 16.

A substantially cylindrical opening or opener roller 17 or equivalent structure is provided immediately adjoining or adjacent the feed rolls 13 at the outlet side thereof. Distributed over the substantially cylindrical outer or jacket surface 18 of the opening roller 17 are needles or spikes 19 or the like extending outwardly from this opening roller 17. In addition, operating elements 20 and 21, such as a deflector element 20 and an impact element 21 are provided. The deflector element 20 is pivotable about a pivot shaft or axis 22 and can be appropriately adjusted or set to assume various or predeterminate angular positions. The impact element 21 is also adjustable into predeterminate or desired positions between, for instance, the positions illustrated in dotted lines in FIGS. 1 and 2.

From the opening or opener roller 17, fiber flock material freed by means of the needles or spikes 19 is propelled or hurled into a feed chute 23 or the like. In this feed chute 23, the fiber flocks are collected to form a feed batt or batt 24 which is thereafter further transported by conventional and therefore here non-illustrated means provided at the lower end of the feed chute 23, as is likewise well known in this art. Finally, the feed batt or batt 24 passes to the feed cylinder of, for instance, a suitable card or carding machine, also not illustrated in order to simplify the showing of the drawings.

In addition to the needles 19, the cylindrical portion or substantially cylindrical outer surface 18 of the opening roller 17 is provided with outwardly extending or protruding vanes or blades 25 or equivalent structure. These vanes or blades 25 are each of substantially strip form or strip-shaped configuration and extend substantially parallel to the surface generator lines or generatrices of the substantially cylindrical outer surface 18 of the opening roller 17, and thus, essentially at right angles or perpendicular to the plane of the drawing of FIGS. 1 and 2. Each of these vanes or blades 25 is appropriately fixed or secured at a long or lengthwise extending side thereof, as generally indicated in FIG. 2 by reference character 25*a*, to the substantially cylindrical outer or jacket surface 18 of the substantially cylindrical opening roller 17.

Figure 1:
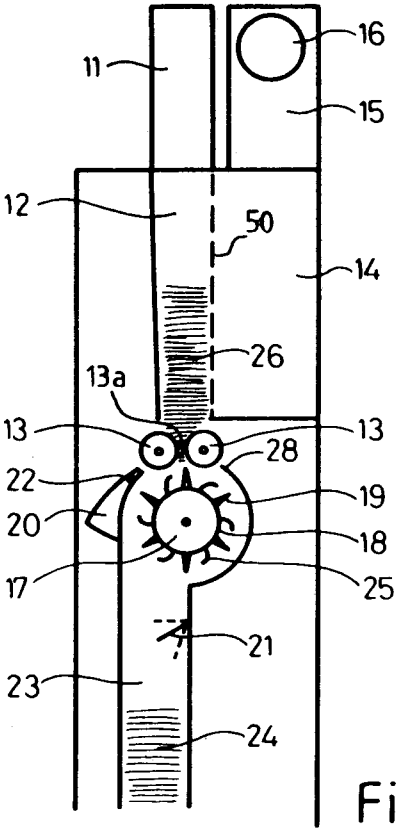
FIG. 1 shows a schematic fragmentary side-view of an arrangement or apparatus constructed in accordance with the present invention and serving for the supply of fiber or fibrous materials to a fiber processing machine.

During operation of the arrangement or apparatus shown in FIGS. 1 and 2, the fiber material which is in the form of, for instance, fiber flocks and flowing into the extraction or separation head 11 is collected in the feed chute 12. This is achieved by means of an airstream flowing from the extraction or separation head 11 into the feed chute 12 and through the plenum chamber 14. This airstream flows out again through the housing 15 and the air exit or discharge opening 16. The collected fiber flocks or fiber flock material 26 is fed by means of the coacting feed or nipping rollers 13 to the opening or opener roller 17 which in operation rotates continuously about its lengthwise extending or rotational axis in the direction of the arrow 27 (FIG. 2). The needles or spikes 19 tear along or extract fiber material in the form of flocks and propel this material into the feed chute 23 where it falls downwardly and is compressed so as to form a feed batt or batt 24.

In accordance with the invention, the substantially strip-shaped or elongated vanes or blades 25 are provided in addition to the needles or spikes 19. These vanes or blades 25, as previously stated, are advantageously formed as elongated strips which are arranged substantially parallel to the generatrices or generator lines of the cylinder portion or substantially cylindrical outer or jacket surface 18 of the opening roller 17 and extend outwardly from this outer surface 18 thereof. In the exemplary embodiment illustrated in these FIGS. 1 and 2, the vanes or blades 25 are rearwardly or backwardly curved with respect to the direction of rotation of the opening roller 17 and which rotational direction, as previously noted, has been indicated by the arrow 27 in FIG. 2.

In the specific exemplary embodiment depicted in FIGS. 1 and 2, the needles or spikes 19 are arranged in rows extending along generatrices or generator lines of the cylindrical portion or cylindrical outer or jacket surface 18 of the opening roller 17. In such exemplary embodiment there is shown one such vane or blade 25 which is located between each pair of neighboring rows of needles 19 or the like. Each substantially strip-shaped vane or blade 25 extends in its longitudinal or lengthwise direction in a direction which is disposed substantially parallel to the generatrices or generator lines over the complete length of the opening roller 17. The height of each of the vanes or blades 25, measured from the outer surface 18 of the opening roller 17, is smaller than the height of the needles 19 measured from such outer surface 18.

In those types of opening rollers in which the rows of needles or the like extend at an angle to the generatrices or generator lines the direction of extent of the vanes or blades 26 is also inclined with respect to the generatrices or generator lines, since the vanes or blades lie substantially parallel to the rows of needles. The vanes or blades 25 do not have to be arranged exactly parallel to the generatrices or generator lines in order to achieve the advantages attained in accordance with the teachings of the invention. However, they are advantageously arranged "substantially" parallel to these generatrices.

As already mentioned, the vanes or blades 25 cause an improvement in the entrainment or carrying along of the air so that the provision of the vanes or blades 25 results in an increase in the air throughflow, which however only attains a very moderate level, and primarily results in an increased air pressure in the feed chute 23. This results in a heavier and more even feed batt or batt 24 than would be otherwise achieved in the absence of the vanes or blades 25. The increased air pressure and the greater air throughflow produce a more even distribution of the fiber material because this fiber material is moved more strongly, and possibly with the addition of transverse movements superposed thereon, into the empty spaces or interstices which can initially arise between individual flocks of the fiber flocks or fiber material.

Fiber material fed through the feed rollers 13 is compressed or pressed together by these feed rollers 13. Also, only a minimal amount of space is left laterally of this roller pair between the feed rollers 13 and respectively the deflector element 20 and the end edge or region 28 of the curved portion 28a of the feed chute 23. Accordingly, as also previously mentioned, for a constant speed of rotation of the opening roller 17, the vanes or blades 25 do not cause any notable increase in the speed of the fiber flocks moving away from the opening roller 17, but only an increase in the air throughflow through the feed batt or batt 24 which is inherently at a very moderate level.

Tests have shown that in an arrangement or apparatus constructed in accordance with the invention a very approximately 730 g/m) about 20% higher in comparison to the batt density (of approximately 610 g/m) of a feed batt or batt formed by an opener roller devoid of the vanes or blades 25.

Also, with reference to the evenness of the feed batt or batt 24 created in this manner, a decisive improvement was obtained. Thus, the coefficient of variation $CV_{1m}$ of a card sliver produced when using an arrangement for supplying fiber material and constructed without vanes or blades on the opening roller of the feed chute was equal to 3.6%, while the corresponding value of the card sliver produced with vanes or blades 25 on the opening roller 17 was equal to 2.96%.

Depending upon the circumstances, the additional use of the operating elements 20 and 21, namely, the deflector element 20 and the impact element 21, can be advantageous. The deflector element 20 and the impact element 21 serve primarily to reduce the kinetic energy of the fiber flocks and to enable even distribution thereof. The use of each of the operating elements 20 and 21 individually or collectively in combination with the present invention therefore results in additional homogenization of the feed batt or batt 24.

In the embodiment shown in FIGS. 1 and 2 and as will be evident from the illustration thereof, the vanes or blades 25 are curved over their entire width or height rearwardly with respect to the direction of rotation of the opening roller 17 indicated by the arrow 27. This curvature has the purpose of avoiding retention of fibers. The use of such curved configured vanes or blades 25 affords the additional advantage that turbulence of fiber flocks in the feed chute 23 is reduced; this also has a positive effect on the evenness of the feed batt or batt 24. In another, non-illustrated embodiment, the vanes or blades are formed as substantially planar strips which can even extend at substantially right angles or perpendicular to the outer surface 18 of the opening roller 17. In still another embodiment, the vanes or blades are rearwardly or backwardly curved only in those vane or blade portions located remote from the outer surface of the opening roller and which curved vane or blade portions each extend in the longitudinal or lengthwise direction of the corresponding vane or blade.

Figure 3:
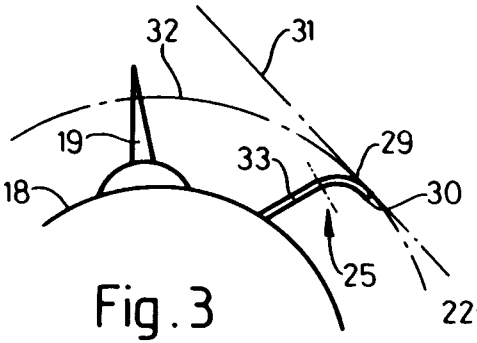
FIG. 3 schematically illustrates details of a modified construction of the vanes of blades arranged at the opening roller of the fiber supplying arrangement or apparatus depicted in FIGS. 1 and 2.

In FIG. 3 there has been illustrated an exemplary embodiment constructed in the manner just described. Each vane or blade 25 has a strip-like portion or section 33 located adjacent the outer surface 18 of the opening roller 17, this vane or blade portion 33 being planar. However, each such vane or blade 25 also has a strip-like vane or blade portion or section 29 located remote from the outer surface 18 of the opening roller 17 and having one long or lengthwise extending side defined by the free edge or free end edge 30. This vane or blade portion 29 is curved, as shown in FIG. 3. It has a curvature such that, at the location of the free edge or free end edge 30, the tangents 31 to the vane or blade portion 29 disposed at right angles to the free edge or free end edge 30 coincide or essentially coincide with the tangents at the same location taken with respect to the cylindrical surface or envelope 32 described or swept out by the free edge or free end edge 30 during rotation thereof.

As explained previously, the vanes or blades 25 may also be devoid of any curved portions, and thus, in the arrangement of FIG. 3 it need only be imagined that the strip-like portion or section 33 of the vanes or blades 25 extends linearly further to the region of the cylindrical surface or envelope 32.

In general for the various embodiments herein described, good results are obtained if the height of the vanes or blades 25 measured from the outer surface 18 of the opening roller 17 lies in a range between about one-half and two-thirds of the height of the needles or spikes 19.

It has proved advantageous to manufacture the vanes or blades 25 from a strong or rigid material, such as for instance sheet metal or plastic.

While there are shown and described present preferred embodiments of the invention, it is to be distinctly understood that the invention is not limited thereto, but may be otherwise variously embodied and practiced within the scope of the following claims. Accordingly,

What we claim is:

1. An arrangement for supplying a fiber processing machine, for example a card, with fiber flock material, comprising:

a feed device containing two feed rollers cooperating with one another to form therebetween a nip;

a rotatable substantially cylindrical opening roller having an outer surface and coacting with said two feed rollers;

said two feed rollers serving to feed fiber flock material to said rotatable substantially cylindrical opening roller;

said rotatable substantially cylindrical opening roller being provided with needles distributed over said outer surface thereof;

said needles extending outwardly from said outer surface of said substantially cylindrical opening roller;

a feed chute cooperating with said substantially cylindrical opening roller and having an entrance location;

said substantially cylindrical opening roller being located at the region of said entrance location of said feed chute;

said substantially cylindrical opening roller being provided with substantially strip-shaped vanes located between said needles on said outer surface of said substantially cylindrical opening roller;

said outer surface of said substantially cylindrical opening roller being defined by generatrices;

each of said substantially strip-shaped vanes having at least one lengthwise extending side;

said substantially strip-shaped vanes being fixedly secured to said outer surface of said substantially cylindrical opening roller along said at least one lengthwise extending side and extending outwardly from said outer surface of said substantially cylindrical opening roller and substantially parallel to said generatrices;

each of said needles having a predeterminate height from the outer surface of said substantially cylindrical opening roller;

each of said substantially strip-shaped vanes having a predeterminate height from the outer surface of said substantially cylindrical opening roller; and the predeterminate height of said substantially strip-shaped vanes being less than the predeterminate height of said needles.

2. The arrangement as defined in claim 1, further including:

an operating element located at the region of fiber material leaving said substantially cylindrical opening roller and serving to deflect in a predeterminate direction of flow the fiber material and to reduce to a predeterminate speed of flow the fiber material.

3. The arrangement as defined in claim 1, wherein:

said substantially cylindrical opening roller has a predetermined direction of rotation;

each of said substantially strip-shaped vanes having a strip-shaped vane portion located remote from the outer surface of said substantially cylindrical opening roller;

said substantially srtip-shaped vanes being curved with respect to said predetermined direction of rotation of said substantially cylindrical opening roller at least at said strip-shaped vane portion which is located remote from the outer surface of said substantially cylindrical opening roller; and each said strip-shaped vane portion extending in the lengthwise direction of the associated vane.

4. The arrangement as defined in claim 3, wherein:

each of said strip-shaped vane portions has a free end edge located remote from the outer surface of said substantially cylindrical opening roller;

said free end edge of said strip-shaped vane portions of said substantially strip-shaped vanes describing a substantially cylindrical surface during rotation of said substantially cylindrical opening roller; and tangents taken with respect to said strip-shaped vane portion and extending substantially normal to the free end edge thereof substantially coinciding with tangents taken at the same location with respect to the substantially cylindrical surface described by the free end edge during the rotation of said substantially cylindrical opening roller.

5. The arrangement as defined in claim 3, wherein:

said substantially strip-shaped vanes being curved rearwardly with respect to said predetermined direction of rotation of said substantially cylindrical opening roller at least at said strip-shaped vane portion.

6. The arrangement as defined in claim 1, wherein:

said needles are arranged in substantially parallel rows extending along the generatrices of the outer surface of said substantially cylindrical opening roller; and said substantially strip-shaped vanes being arranged alternately between said substantially parallel rows of needles.

7. The arrangement as defined in claim 1, wherein:

said substantially strip-shaped vanes are formed of a substantially rigid material.

8. The arrangement as defined in claim 1, wherein:

said substantially strip-shaped vanes are structured as substantially planar elements.

9. The arrangement as defined in claim 1, wherein:

the height of said substantially strip-shaped vanes lies between about one-half and two-thirds of the height of the needles.

10. An arrangement for supplying a fiber processing machine with fiber material, comprising:

a feed device containing two coating feed rollers;

a rotatable opening roller having an outer surface and arranged downstream of said two feed rollers with respect to a predetermined direction of movement of said two feed rollers and a predetermined direction of movement of fiber material between said two feed rollers;

said two feed rollers serving to feed the fiber material to said rotatable opening roller;

said rotatable opening roller being provided with needles arranged at said outer surface thereof;

said needles extending outwardly from said outer surface of said rotatable opening roller;

a feed chute cooperating with said rotatable opening roller and having an entrance location for the fiber material;

said rotatable opening roller being arranged to cooperate with said entrance location of said feed chute;

said rotatable opening roller being provided with elongated vanes between said needles on said outer surface of said rotatable opening roller;

each of said elongated vanes having at least one lengthwise extending side;

said elongated vanes being fixedly secured to said outer surface of said rotatable opening roller along said at least one lengthwise extending side and extending outwardly of said outer surface of said rotatable opening roller;

said elongated vanes increasing, during rotation of the rotatable opening roller, air pressure at the region of the entrance location of the feed chute and thus increasing pressure exerted on the fiber material located in the feed chute, to thereby form a substantially uniform fiber structure of increased weight in the feed chute;

each of said needles having a predeterminate height in relation to the outer surface f said rotatable opening roller;

each of said elongated vanes having a predeterminate height in relation to the outer surface of said rotatable opening roller; and the predeterminate height of said elongated vanes being less than the predeterminate height of said needles.

11. An arrangement for supplying a fiber processing machine with fiber material, comprising:

a feed device containing two coating feed rollers;

a rotatable opening roller having an outer surface and arranged downstream of said two feed rollers with respect to a predetermined direction of movement of said two feed rollers and a predetermined direction of movement of fiber material between said two feed rollers;

said two feed rollers serving to feed the fiber material to said rotatable opening roller;

said rotatable opening roller being provided with needles arranged at said outer surface thereof;

said needles extending outwardly from said outer surface of said rotatable opening roller;

a feed chute cooperating with said rotatable opening roller and having an entrance location for the fiber material;

said rotatable opening roller being arranged to cooperate with said entrance location of said feed chute;

said rotatable opening roller being provided with elongated vanes between said needle on said outer surface of said rotatable opening roller;

each of said elongated vanes having at least one lengthwise extending side;

said elongated vanes being fixedly secured to said outer surface of said rotatable opening roller along said at least one lengthwise extending side and extending outwardly of said outer surface of said rotatable opening roller; and said elongated vanes increasing, during rotation of the rotatable opening roller, air pressure at the region of the entrance location of the feed chute and thus increasing pressure exerted on the fiber material located in the feed chute, to thereby form a substantially uniform fiber structure of increased weight in the feed chute.

* * * * *

UNITED STATES PATENT AND TRADEMARK OFFICE

CERTIFICATE OF CORRECTION

PATENT NO. : 4,797,979

DATED : January 17, 1989

INVENTOR(S) : PAUL STäHELI et al

It is certified that error appears in the above-identified patent and that said Letters Patent is hereby corrected as shown below:

Column 3, line 3, please delete "follow" and insert --hollow--

Column 5, line 57, after "very" please insert --good, even feed batt is obtained having a batt density (of--

Column 8, line 48, please delete "coating" and insert --coacting--

Column 9, line 16, please delete "f" andinsert --of--

Column 9, line 27, please delete "coating" and insert --coacting--

Signed and Sealed this

Twenty-sixth Day of September, 1989

*Attest:*

DONALD J. QUIGG

*Attesting Officer*

*Commissioner of Patents and Trademarks*